United States Patent [19]

Galvin

[11] 3,946,376

[45] Mar. 23, 1976

[54] MULTIPLE ZONE INTRUSION ALARM SYSTEM

[75] Inventor: Aaron A. Galvin, Lexington, Mass.

[73] Assignee: American District Telegraph Company, New York, N.Y.

[22] Filed: June 11, 1974

[21] Appl. No.: 478,370

[52] U.S. Cl. ..... 340/258 R; 340/16 R; 340/258 A

[51] Int. Cl.[2] ..... G08B 13/16

[58] Field of Search ..... 340/258 R, 258 A, 258 B, 340/258 D, 16 R, 261

[56] References Cited

UNITED STATES PATENTS

| | | | |
|---|---|---|---|
| 3,680,074 | 7/1972 | Lieser | 340/258 A |
| 3,774,190 | 11/1973 | Kyle | 340/258 R |
| 3,781,859 | 12/1973 | Hermans | 340/258 A |
| 3,831,162 | 8/1974 | Armstrong | 340/261 |

*Primary Examiner*—David L. Trafton
*Attorney, Agent, or Firm*—Weingarten, Maxham & Schurgin

[57] ABSTRACT

An intrusion alarm system for a plurality of protected zones and operative to provide an indication of a particular zone in which intrusion has occurred. Relatively low performance, low cost signal processing circuitry is provided for each protected zone, with a single high performance processor provided for an entire system. The lower performance circuitry provides respective signals indicative of an alarm condition in corresponding zones, the high performance processor being operative to confirm the presence of an actual intruder and only upon such confirmation to cause an output alarm indication.

6 Claims, 1 Drawing Figure

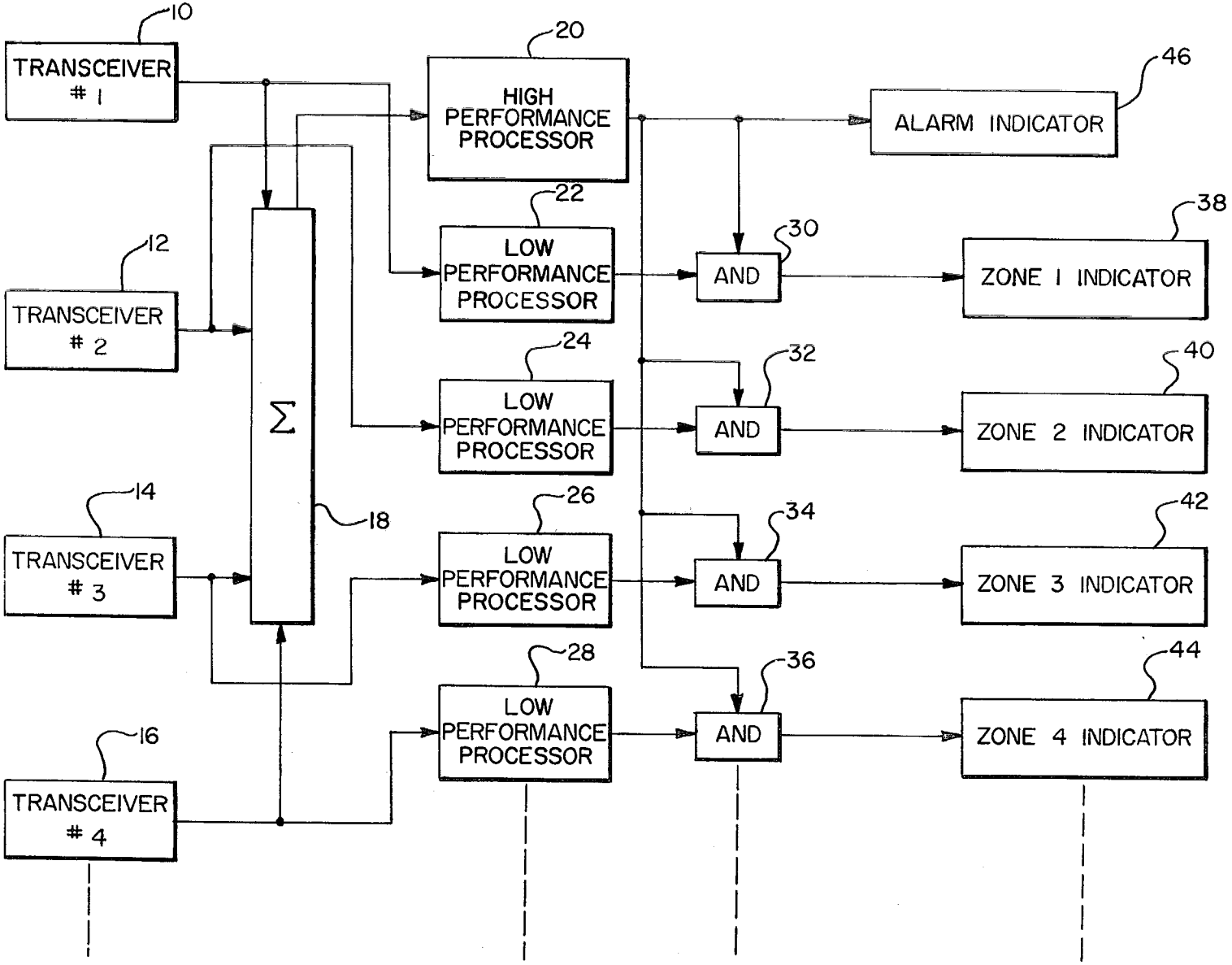
TRANSCEIVER # 1
10
TRANSCEIVER # 2
12
TRANSCEIVER # 3
14
TRANSCEIVER # 4
16
Σ
18
HIGH PERFORMANCE PROCESSOR
20
LOW PERFORMANCE PROCESSOR
22
LOW PERFORMANCE PROCESSOR
24
LOW PERFORMANCE PROCESSOR
26
LOW PERFORMANCE PROCESSOR
28
AND
30
AND
32
AND
34
AND
36
ALARM INDICATOR
46
ZONE 1 INDICATOR
38
ZONE 2 INDICATOR
40
ZONE 3 INDICATOR
42
ZONE 4 INDICATOR
44

MULTIPLE ZONE INTRUSION ALARM SYSTEM

FIELD OF THE INVENTION

This invention relates to intrusion alarm systems and more particularly to systems for detection of intruders in one or more multiple zones and for providing an indication of the zones in which intrusion occurs.

BACKGROUND OF THE INVENTION

Systems are known for detection of intrusion within a protected zone. Many such systems employ Doppler techniques in which a signal is propagated within a zone under surveillance, and signals returned from the zone and from objects therein processed to determine intruder presence by a Doppler signal detectable as an indication of intruder presence. A major requirement of all practical intrusion alarm systems is the reliable discrimination between an actual intruder and noise or other spurious conditions which could give rise to a false alarm indication of intrusions. Sophisticated electronic signal processing circuits have been developed for providing such discrimination, and such processors are a relatively expensive portion of an overall system. For many installations, multiple zones are under surveillance and a common signal processor is employed to receive signals from each of the zones. However, this type of system will provide an alarm when any zone is intruded, but the alarm will not be indicative of the particular zone in which intrusion has occurred. In order to provide identification of the particular zone being intruded, systems of conventional construction employ individual signal processors for each zone, which can materially add to the cost and complexity of an installed system.

SUMMARY OF THE INVENTION

The present invention provides a multiple zone intrusion alarm system having a single processor of high performance shared by all zones, and multiple signal processors of relatively lower performance for each zone under surveillance. Signals received from one or more zones in which may be indicative of intruder presence are processed by the high performance processor as well as by corresponding ones of the lower performance processors. The high performance processor is operative to discriminate between an actual intruder and spurious signal conditions such as noise and provide an output signal indicative of intruder presence but without indication of the particular zone being intruded. The lower performance processors offer little if any discrimination between an actual intruder and spurious signal conditions and provide corresponding output signals indicative of an alarm condition in particular zones when an intruder is present but also as a result of spurious conditions. These lower performance processors therefore exhibit a rather high false alarm rate.

The output signals from the high performance processor and the plurality of lower performance processors are gated to provide an output indication of intruder presence only in the presence of an output signal for a lower performance processor and from the high performance processor. The lower performance processors, which can be of substantially less cost than the high performance processor, thus provide respective signals indicative of an alarm condition in corresponding zones, the high performance processor being employed to confirm the presence of an actual intruder and only upon such confirmation to cause an output alarm indication. The high cost system components are thus shared for an entire system, while only the lower cost system components are employed multiply for the several protected zones.

DESCRIPTION OF THE DRAWING

The invention will be more fully understood from the following detailed description taken in conjunction with the accompanying drawing, the single FIGURE of which is a block diagram representation of a multiple zone intrusion alarm system according to the invention.

DETAILED DESCRIPTION OF THE INVENTION

The preferred embodiment will be described in the context of a multiple zone Doppler intrusion alarm system for the surveillance of a plurality of zones being protected and for an indication of the particular zone or zones in which intrusion occurs. A plurality of transceivers 10, 12, 14 and 16 is provided, each being disposed in a respective zone under surveillance and each typically including a transmitting transducer for propagating ultrasonic, electromagnetic or other suitable energy into the corresponding zone, a receiving transducer for receiving energy returned from the zone and from objects therein, and a preamplifier for amplifying the signals provided by the receiving transducer in response to returned energy. The received signals in the presence of an intruder moving within a surveillance zone contain Doppler information representative of intruder presence and these signals are conveyed, typically via interconnecting wiring to processing circuity usually located remote from the transceivers and operative to discriminate actual intruders from noise or other spurious signal conditions and to provide an output indication of intruder presence. In the illustrated embodiment, a four zone system is shown, but it will be appreciated that the invention is equally applicable to different numbers of zones.

The receiver outputs of the transceivers 10–16 are coupled via suitable interconnecting wiring to a summing circuit 18, such as a resistor adder, the output of which is applied to a high performance signal processor 20. A logical OR gate can be employed alternatively to summing circuit 18. The receiver outputs of transceivers 10–16 are respectively coupled to the inputs of respective lower performance signal processors 22–28, the outputs of which are coupled to respective AND gates 30–36. The output of processor 20 is applied as a second input to each of the AND gates 30–36, and to an alarm indicator 46. The output of each AND gate is applied to respective zone indicators 38–44 which provide indication of the particular zone in which intrusion occurs.

The processor 20 provides discrimination between an actual intruder and noise or spurious signal conditions that could otherwise cause a false alarm indication. Such a processor of preferred implementation is shown in U.S. Pat. No. 3,665,443, assigned to the assignee of this invention. The processors of 22–28 are of relatively unsophisticated design providing little or no discrimination between an actual intruder and noise or spurious signal conditions, and are thus subject to relatively high false alarm rates. According to the invention, intruder presence as determined by processors 22–28 must be confirmed by processor 20 in order for an alarm indication to be produced.

In the presence of an intruder in one or more surveillance zones, the receiver associated with each intruded zone provides an output signal via summing network 18 to processor 20 which provides an alarm signal for actuation of a suitable alarm indicator 46. The signal from the receiver associated with the intruded zone is also applied to a corresponding one of processors 22–28 which provides a signal, via the corresponding one of AND gates 30–36, to a zone indicator 38–44 which denotes a particular zone being intruded. The AND gates are enabled by the output signal from processor 20, no zone display is actuated, thereby preventing a false indication of zone intrusion unless the presence of an intruder is confirmed by operation of processor 20. The zone indicators 38–44 may provide the sole output indication from the system, or a system alarm indication by indicator 46 can be provided with the particular intruded zone being separately denoted by indicators 38–44.

By virtue of invention, a multiple zone intrusion alarm system is provided in which intruder detection is indicated for particular zones at substantially less cost than conventional systems and without sacrifice of the high order of discrimination between an actual intruder and spurious signal conditions required in a commercially realistic system. The invention is applicable to a variety of Doppler and other intrusion alarm systems, both active and passive. In an active system, such as in the embodiment illustrated, energy is directed into the surveillance zones and energy returned from the zones is processed to denote intruder presence. In a passive system, energy produced at the zones is received for processing. Any such received energy can be employed for processing according to the invention. The invention can also be variously implemented to suit specific requirements and is thus not to be limited by what has been particularly shown and described, except as indicated in the appended claims.

What is claimed is:

1. A multiple zone intrusion alarm system comprising:

a plurality of transmitting and receiving means each disposed in a respective zone under surveillance and each including means for propagating a signal in said zone and means for receiving signals returned from said zone and from objects therein;

a plurality of low performance signal processors each coupled to a corresponding one of said receiving means for receipt of returned signals therefrom and for providing in response to said returned signals an output signal representative of possible intruder presence in a corresponding zone;

a single high performance signal processor operative to discriminate between an actual intruder and spurious signal conditions;

means for coupling said receiving means to said high performance processor for conveyance of each of said returned signals thereto; and gating means receiving the output signal from said high performance processor and the output signals from said low performance processors and operative to provide output signals indicative of intruder presence in the zones in which intrusion is detected only upon receipt of at least one output signal from said plurality of low performance signal processors and an output signal from said high performance signal processor.

2. A multiple zone intrusion alarm system according to claim 1 wherein said gating means includes:

a plurality of AND gates each receiving the output signal from said high performance processor and the output signal from a respective one of said low performance processors and operative to provide output signals indicative of intruder presence in the corresponding one of said zones.

3. A multiple zone intrusion alarm system according to claim 2 further including:

a plurality of indicators each operative in response to a respective one of said output signals from said AND gates to provide an output indication of intruder presence in a corresponding one of said zones.

4. A multiple zone intrusion alarm system according to claim 3 further including:

an indicator operative in response to the output signal from said high performance processor to provide an output indication of intruder presence in one or more of said zones.

5. A multiple zone intrusion alarm system according to claim 2 wherein said coupling means includes a summing circuit for conveyance of each of said returned signals to said high performance processor.

6. In an intrusion alarm system for detecting an intruder in any of a plurality of protected zones, including:

means for propagating a signal in each of the zones, and means for receiving signals from the zones after the signals have interacted with the zones and with objects therein so as to contain information indicating the presence of an intruder;

improved circuitry for determining in which zone an intrusion has occurred, comprising:

a first signal processor capable of discriminating between an actual intruder and spurious signal conditions, and operative in response to the signals from each of these zones to provide a first signal indicating an intrusion;

a plurality of second signal processors providing minimal discrimination between an actual intruding body and spurious signal conditions and each operative in response to the signals from a respective zone to provide a second signal indicating the possibility of an intrusion in that zone; and a plurality of gating means each operative in response to the first signal and to a respective one of the second signals to provide an output indication of intrusion in particular ones of these zones only upon the presence of both the first signal and the second signal for a particular zone.

* * * * *